US006035493A

United States Patent [19]

Carlton

[11] Patent Number: 6,035,493

[45] Date of Patent: Mar. 14, 2000

[54] TEXTILE CARDING AND RELEVANT APPARATUS

[76] Inventor: William Charles Carlton, Villa Tas-Silg, Delimara Road, Marsaxlokk, ZTN 09, Malta

[21] Appl. No.: 09/117,203

[22] PCT Filed: Feb. 7, 1996

[86] PCT No.: PCT/GB96/00235

§ 371 Date: Jul. 24, 1998

§ 102(e) Date: Jul. 24, 1998

[87] PCT Pub. No.: WO97/29226

PCT Pub. Date: Aug. 14, 1997

[51] Int. Cl.[7] ..... D01G 15/00

[52] U.S. Cl. ..... 19/98; 19/101; 19/114

[58] Field of Search ..... 19/98, 99, 100, 19/101, 105, 106 R, 108, 109, 112, 114

[56] References Cited

U.S. PATENT DOCUMENTS

| | | | |
|---|---|---|---|
| 4,090,276 | 5/1978 | Roberts | 19/99 |
| 4,627,131 | 12/1986 | Iwata | 19/112 |
| 4,843,685 | 7/1989 | Vesa et al. | 19/98 |
| 5,655,262 | 8/1997 | Sterin et al. | 19/114 |

FOREIGN PATENT DOCUMENTS

| | | |
|---|---|---|
| 1075444 | 7/1967 | United Kingdom . |
| 1412109 | 10/1975 | United Kingdom . |

*Primary Examiner*—John J Calvert
*Assistant Examiner*—Gary L. Welch
*Attorney, Agent, or Firm*—Clifford W. Browning; Woodard, Emhardt, Naughton Moriarty & McNett Patent and Trademark Attorneys

[57] ABSTRACT

A carding machine incorporating a train of co-operating rollers (40, 41, 42, 43, 44, 72, 73, 74, 75, 76), each roller incorporates angled forward (118) and backward (119) facing teeth and each roller rotates in the opposite direction to and with a surface speed substantially faster than its predecessor, thus causing in said train at least one slower input section (42, 43) and a faster output section (73, 74, 75, 76). The machine incorporates interleaved rings of teeth (14) in precise construction to increase the feed of fibers from the slower entry end of the train to take advantage of the (potentially) faster output of the fibers at the exit end of the train. The carding is done in a substantially rectangular manner as the fibers pass through the train. It is preferred that at least in the slower input section of the train each roller incorporates rings of forward-backward teeth (120, 121) which are integral with the special outer part (81) of the rollers (79). One construction includes a device to remove the fibers at high speed from the exit end of the train. This device includes a doffer (152), first (153) and second (154) take-off rollers and air jets (156, 157) passing between the doffer, the second take-off roller and the first take-off roller.

32 Claims, 5 Drawing Sheets

TEXTILE CARDING AND RELEVANT APPARATUS

TECHNICAL FIELD

The invention is in the field of textiles and particularly relates to carding and fibre opening machines and to rollers for use in such machines.

BACKGROUND ART

The background art comprises two main groups viz. conventional carding machines hereinafter referred to as the prior art and Robert's specifications U.S. Pat. No. 4,090,276, GB. 1,412,109 and GB 1,075,444 which particularly concern the present invention and are hereinafter referred to as the relevant prior art. These latter specifications may briefly be described as providing a carding machine incorporating a train of at least three adjacent co-operating rollers, each roller of which has a first set of effective teeth which are angled forwardly (with respect to the direction of motion) and a second set of effective teeth which are angled rearwardly and which may also incorporate a roller having threaded-on rings of teeth; further, the teeth co-operate in point to point fashion and further, each of the said adjacent rollers in the train runs at a faster surface speed than its predecessor.

In the parts of this specification and claims relating to the present invention, certain words and expressions have special meanings ascribed to them as follows:

A 'carding machine' is a machine used for the opening of staple fibres and in this specification may include machines used for attenuating, aligning and combing fibres and other related operations.

A 'roller' is a part of a carding machine in which teeth are incorporated. In this specification, when referring to the relevant prior art, the roller is made up in two parts, the core and its separate card clothing which is usually wound on to the core. In one instance, however, the card clothing is made up of endless rings which are threaded on to the core. Two important distinctions between the prior art, the relevant prior art and one preferred form of the present invention is that in one section of the latter rings of teeth are interleaved and are, for this purpose, secured in precisely predetermined positions on the roller.

In one preferred form of the present invention, a roller consists of a roller bearing means and a special outer part in which the teeth are rooted.

'Special outer part' is the rigid outer part of a roller used in one preferred form of the present invention and is preferably made of steel. It may be integral with the roller bearing means or be a thick metal sleeve which is secured to the roller bearing means.

'Teeth' are projections attached to rollers said teeth acting on the fibres to card, open, attenuate and/or comb them. 'Circumferential' describes a feature in a roller which runs around the circumference of a roller substantially at a right angle to the axis.

'Axial' describes a feature in a roller which runs along, the perimeter of a roller substantially in the direction of the axis.

'A ring of teeth' is a circle of teeth at a right angle to the axis of a roller.

'The base of a tooth' in one preferred form of the present invention is that part of a tooth by which it is attached to the special outer part of a roller. Preferably the teeth, the base and the special outer part are integral with each other. Alternatively, 'The base of a tooth' might include the flexible wire base of metallic wound-on teeth if the said base were integral with the said teeth and, for instance, swaged into grooves machined in the said special outer part. The criterion for the said preferred for is that the bases must be secured in predetermined positions in relation to the axis of the roller. Nevertheless, in one form of the invention the base of a tooth is the flexible wire base of wound-on teeth.

An 'angled forward' tooth has an effective leading edge inclined in the direction of rotation.

An 'angled rearward' tooth has an effective trailing edge inclined in the direction opposite to that of rotation.

A 'forward-rearward tooth' combines the features of the above teeth and has effective leading and trailing edges.

An 'angled forward-backward facing tooth' is a tooth in which the leading edge is inclined in the direction of rotation and the trailing edge is backward facing but is also inclined in the direction of rotation.

The 'trailing edge' is the backward facing edge of a tooth when the roller is rotating in its normal direction. It is not necessarily 'angled rearwardly' as in the relevant prior art.

The 'height' of a tooth is the distance between its outside edge and its base where it ceases to be effective as a tooth.

A 'blade' is a circumferential edge connecting the points on the trailing and leading edges of a single tooth.

'Surface teeth' are adapted to card in point to point fashion with teeth in a co-operating roller across a small gap between the outermost parts of said teeth as distinct from interleaved teeth.

'Wound-on teeth' are surface teeth attached spirally by wrapping around a conventional carding machine roller as distinct from being made spirally, for instance by machining, in the special outer part of a roller.

Rings of teeth in the same family' are related to each other by, for instance, there being a regular mathematical connection with rings of teeth on a co-operating roller even though the rings are not necessarily the same distance apart on both rollers. Related teeth may also share a distinctive shape; such rings are not necessarily the same height above their base as those on the co-operating roller.

'Swaged' means fixed in position, for instance in a groove, by an operation such as rolling or hammering.

'Rooted' means that the base of a tooth is either integral with the special outer part of a roller or is secured in a predetermined position, for instance by swaging in a groove, in the special outer part of a roller.

'Co-operating rollers' are adjacent rollers the teeth of which are working on fibres passing between the said rollers.

'Zone of co-operation' means the area between two co-operating rollers where at least some carding takes place.

In this specification the phrase 'interleaved rings of teeth' means that such rings have the following characteristics:

1. Each ring of teeth is secured in the direction of the axis of its roller in a precisely predetermined position relative to a datum point so that rings of teeth on one co-operating roller may rotate and continue to rotate between rings of teeth similarly constructed on an adjacent co-operating roller without interference between the teeth on any co-operating rollers. 2. There is a predetermined distance between the walls of all interleaved teeth so that there is maintained a substantial clearance between the walls of said teeth so that a) there is no scissor action between teeth which could cause fibre breakage and b) sufficient room is left between teeth to allow carding to proceed smoothly.

A 'lifting surface' is a part of a tooth which is adapted to urge the fibres towards the outside edges of the teeth, to reduce the tendency of fibres to be drawn between the rings of teeth thus reducing fettling and to allow more tolerance in adjustment so that teeth in a succeeding roller can engage the fibres.

A 'tuft' is a small easily carded bunch of fibres,

A 'wad' is a larger bunch of fibres which needs to be broken up before being carded.

Interstices' are small spaces in the component parts of a roller in which fibres are trapped accidentally.

The 'take-off' is the final removal of the fibres from the doffer.

DISCLOSURE OF INVENTION

In accordance with the invention these objects are accomplished by providing a carding machine which includes a train of successive co-operating rollers which incorporate teeth which are angled forward in the direction of rotation and teeth which are angled rearward relative to the direction of rotation and in which each successive co-operating roller rotates in the opposite direction to and with a surface speed substantially faster than, its predecessor, and there being in the said train at least one slower input section and a faster output section and the invention being characterised in that, in the said slower input section there are at least two successive co-operating rollers, said rollers incorporating interleaved rings of teeth, each to said rings incorporating teeth which are angled forward in the direction of rotation and teeth which are angled rearward relative to the direction of rotation, each of said interleaved rings of teeth being precisely secured in the direction of the axis of their respective rollers in a precisely predetermined position relative to their respective datum points so that rings of teeth on one co-operating roller may rotate freely without interference between the teeth on any co-operating rollers and there being a predetermined clearance maintained between the walls of the said teeth.

The invention is developed in that the said slower input section incorporates interleaved rings of teeth and the associated faster output section includes co-operating rollers which incorporate surface teeth.

The invention is further developed in that the said surface teeth incorporate teeth which are angled forward and teeth which are angled rearward.

The invention may be developed in that the said train is in at least three sections, two slower input sections and one faster output section, the said slower input sections bringing the fibres from the slower entry ends of the said train and both said slower input sections converge on each other to meet at a common roller in the body of the said train, the said common roller collecting fibres from the said slower input sections and delivering those fibres to the faster output section, the arrangement being such that the feed of fibres from the slower entry end of said train is substantially balanced by the faster output of fibres at the exit end of said train.

The invention is developed in that at least two co-operating rollers incorporate a roller bearing means, a special outer part and rings of teeth with integral bases, the said bases being rooted in the said special outer part of the said rollers.

The invention is developed in that in the said co-operating rollers with a said special outer part, there are teeth, the bases of which are integral with the said special outer part.

The invention is developed in that the said machine incorporates rings of teeth which incorporate angled forward backward facing teeth.

The invention is developed in that rings of teeth incorporate forward-rearward teeth.

The invention is developed in that some of the said teeth are associated with a lifting surface.

The invention is developed in that the distance between rings of teeth is between 3 mm and 12 mm.

The invention is developed in that the height of the teeth in one co-operating roller is uniformly less than the height of the teeth in an adjacent co-operating roller.

The invention is developed in that at least some of the teeth incorporate blades circumferentially connecting the outer edges of said teeth.

The invention is developed in that, the said carding machine incorporates rollers in which there are no interstices between the bases of some rings of teeth.

The invention is developed in that the said carding machine incorporates at least two co-operating rollers on which the distance between interleaved rings of teeth differs.

The invention is further developed in that there are made co-operating rollers for a carding machine; each said roller incorporating in its said special outer part a plurality of axial grooves along the length of and spaced around the perimeter of the said rollers, said grooves incorporating at least angled forward and angled rearward facing surfaces. And there being made a plurality of circumferential grooves, said grooves being in precise predetermined positions relative to a datum point. The said circumferential grooves crossing the said axial grooves thus making a multiplicity of rings of teeth secured in the direction of the axis of each said roller in a precisely predetermined position, each said ring incorporating at least forward-rearward teeth integral with the said special outer parts.

The invention is further developed in that in the said special outer part the said teeth are separated by spaces having forward and backward facing edges, the outer part of said edges being the edges of the said forward-rearward teeth and the inner part of said edges being lifting surfaces adapted to lift fibres from the inner part of the said spaces adjacent the base towards the outer part of the said teeth.

The invention is further developed in that a carding machine includes a device to remove the fibres at high speed from the exit end of the train the said device incorporating a doffer adapted to remove fibres from the previous adjacent co-operating roller, a first take-off roller adjacent the doffer with its surface direction (where adjacent) in the same direction as that of the doffer, a second take-off roller adjacent the said first take-off roller and with its surface direction (where adjacent) in the same direction as the said first take-off roller; further, an automatic means to compress the fibres as they pass between the said first and second take-off rollers may be incorporated preferably on the said second take-off roller. An air tube may be pierced to direct a plurality of jets of air between the doffer and the said second take-off roller.

The invention is developed in that a compressor conveyor is provided which compresses the fibres before entry into the slower input section of the said train.

ADVANTAGEOUS EFFECTS

A carding machine made according to the invention seeks to increase the output of carding machines relative to their size and weight; to minimize fettling, flying fibres and small entanglements in the wool (naps) and to produce a carding machine in which the fibres flow in a substantially rectilinear manner through the machine to the exit end where the fast flowing fibres are removed at high speed from the doffer.

NODES FOR CARRYING OUT THE INVENTION

Figure 1:
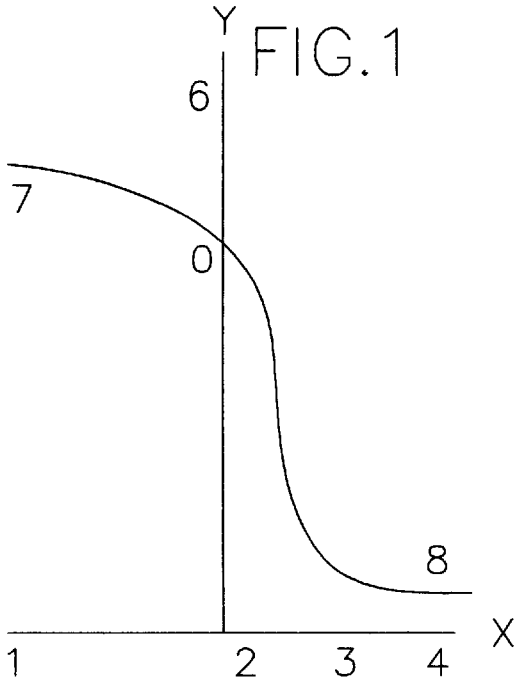
FIG. 1 is a graph showing the relationship of distance between co-operating rollers and fibres transferred.

FIG. 1 illustrates a problem inherent in known carding machines and points to a solution. The x axis 1-2-3-4 indicates in a comparative way, the number of fibres transferred during carding between one co-operating roller and another: 1 indicating many fibres, 2 indicating fewer fibres, 3 indicating still fewer fibres and 4 indicating almost no fibres. The y axis indicates the clearance between the rollers, 5 being a clearance so large that carding is negligible; 0 being almost nil clearance with good transfer of fibres and good carding; this is the position with ideal point to point conditions between the rollers; 6 is negative clearance i.e. the rollers are interleaved and the transfer of fibres is very good. The curve 7-0-8 gives an indication or quantity of fibres transferred against clearance.

Little carding is done not only when the clearance 5 is too large even when a proper flow of fibres is available but also when too many fibres are packed into the said too large clearance 5. The same applies when too many fibres are packed into otherwise ideal point to point conditions at 0; the latter feature limits the thickness of fibres which can usefully be fed into the early more slowly rotating rollers in trains in which succeeding rollers have a progressively faster surface speed than preceding rollers: this leads to a much lesser input than is desirable in this type of machine. A solution is to increase the input beyond the amount possible with conventional carding. This is achieve in the preferred form of this invention by incorporating rollers with interleaved rings of teeth and preferably teeth with lifting surfaces.

Figure 2:
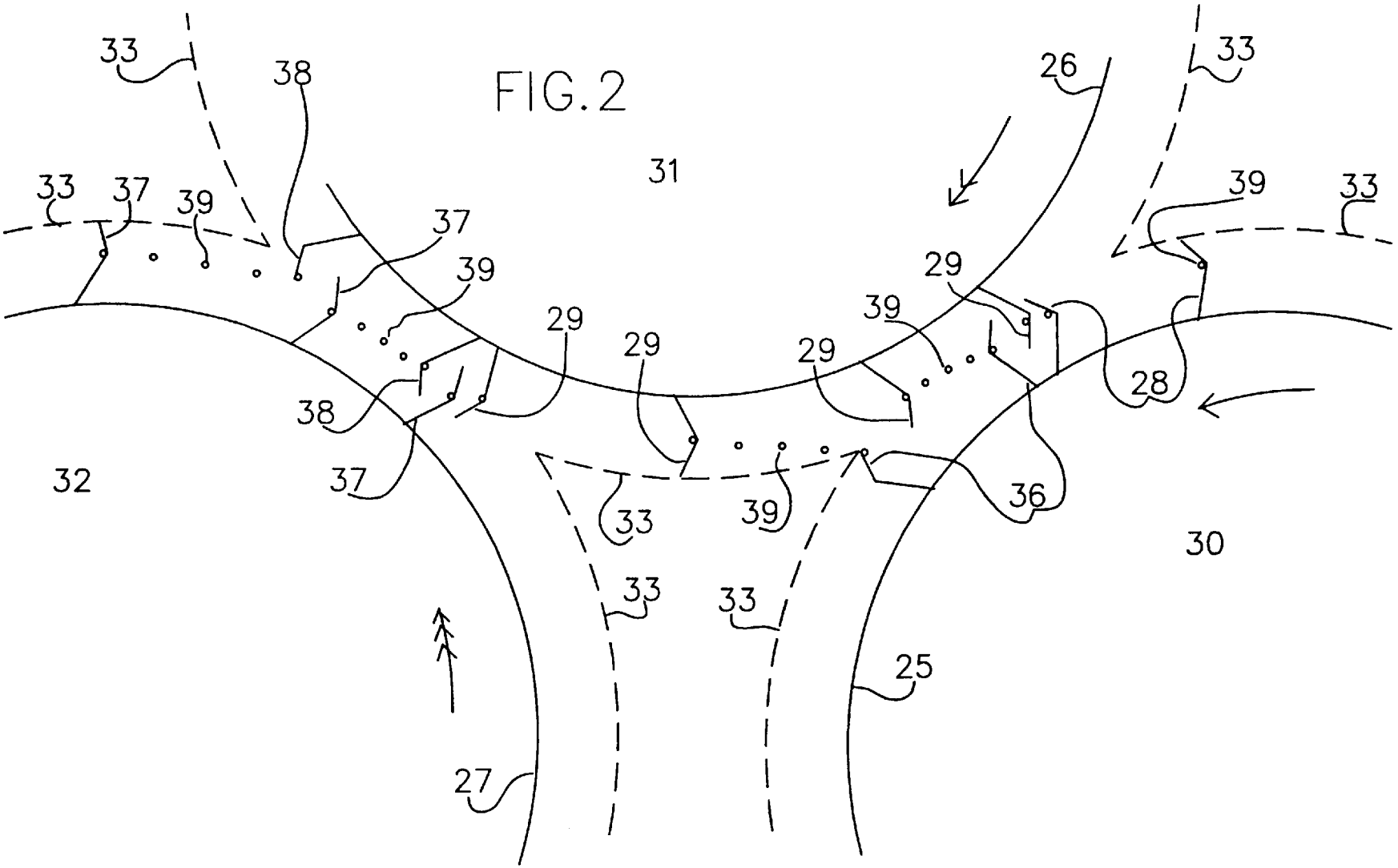
FIG. 2 is a diagrammatic view of the passage of a bunch of fibres between three co-operating rollers, the teeth of which are interleaved according to the invention.

FIG. 2 illustrates diagrammatically a train of three co-operating rollers 30, 31, and 32 incorporating interleaved rings of teeth in the slower input section of a carding machine made according to the invention.

The arrows indicate the direction of rotation of the rollers and the increase in number of arrow-heads indicated that the surface speed of each roller is faster than that of its predecessor. The rings of teeth of roller 31 are interleaved with the rings of teeth of preceding slower moving roller 30 and also with the rings of teeth of succeeding faster moving roller 32. The rollers have been precisely manufactured according to the invention so that the rings of teeth on each roller will interleave with rings of teeth on related co-operating rollers. This interleaving is similar to the interleaving between the rings of teeth on rollers 30 and 31 of which teeth 28 and 36 are representative and the rings of teeth on rollers 31 and 32 of which teeth 29, 37 and 38 are representative. The teeth on roller 30, of which 28 and 36 are examples are integral with its special outer part 25; the teeth on roller 31, of which 29 and 38 are examples are integral with its special outer part 26 and the teeth on roller 32, of which tooth 37 is an example are integral with its special outer part 27. There are a plurality of teeth 28 and 36 on roller 30, 29 and 38 on roller 31 and 37 on roller 32. As the teeth are interleaved they are considered in pairs. The sweep of the teeth is shown by the dashed lines 33; the small circles 39 represent fibres and a row of small circles 39 represents fibres being carded. The slopes of the outer part of the teeth and the position of the small circles relative to the face of the teeth indicate whether the teeth work on the fibres with their front or back faces, and, therefore, whether, in this example, the teeth are angled forward or angled rearward. Interleaving is taking place where the dashed lines may be presumed to overlap.

Angled forward teeth 29 on roller 31 will pass between, for instance, angled forward teeth 28 and angled rearward teeth 36 on roller 30 taking some of the fibres from teeth 28 on roller 30 to teeth 29 on roller 31. Carding is taking place between the back face of tooth 36 and the front face of tooth 29. When tooth 29 has moved round to be in the zone of co-operation between the rollers 31 and 32, teeth 29 will pass between angled forward teeth is 37 on roller 32. These faster moving teeth 37 will immediately transfer some of the fibres from the angled forward teeth 29 to the adjacent angled rearward teeth 38 on roller 31.

For simplicity, only the active effective function of the teeth has been shown, ignoring a different function of that particular tooth in another part of the carding operation. Teeth which have two effective functions are shown elsewhere in the specification. Further, the passage will be considered of only one substantial bunch of fibres 39 shown as a series of small circles as it is carded by attenuation and opening.

Initially, the bunch of fibres 39 is brought forward on the front faces of angled forward teeth 28 on the slower moving roller 30. As the teeth 28 and 29 pass each other interleaving in the zone of co-operation between the rollers 30 and 31, the faster moving front faces of angled forward teeth 29 on roller 31 catch part of the bunch, thus reducing its size, and immediately move it across the small space between the front faces of angled forward teeth 28 and the back faces of angled rearward teeth 36 on roller 30.

The remainder of the bunch is carried forward by the faster moving front faces of teeth 29, the reducing size of the bunch being carded between the slower moving back faces of teeth 36 on roller 30 and the faster moving front faces of teeth 29 on roller 31.

As teeth 29, shown advancing in four positions, rotate with roller 31 and teeth 36, shown advancing in two positions, rotate with roller 30, the fibres are released automatically in a partially carded state from the back faces of teeth 36 and continue an the front faces of teeth 29 into the zone of co-operation between rollers 31 and 32. The same sequence is followed between rollers 31 and 32. In this case the faster moving front faces of angled forward teeth 37, shown advancing in three positions an roller 32, pick up the fibres 39 from teeth 29 on roller 31 and immediately transfer some of the fibres from the front faces of teeth 29 across the small space between the front faces of teeth 29 on roller 31 and the back faces of angled rearward teeth 38 shown advancing in two positions on roller 31.

Carding then continues between the back faces of angled rearward teeth 38 on roller 31 and the front faces of angled forward teeth 37 on roller 32. Additionally, as the aster moving teeth 37 carry some of the fibres past other teeth 38 on the slower rotating roller 31 further carding takes place. The arrangement of interleaved teeth has caused the substantial bunch of initially slow moving and virtually uncarded fibres 39 to flow through the train gradually reducing them in density and increasing them in speed so that they reach the faster output section of the train in an increasingly carded condition. The fibres are thus prepared so that in due course they will pass through rollers incorporating surface teeth.

Figure 3:
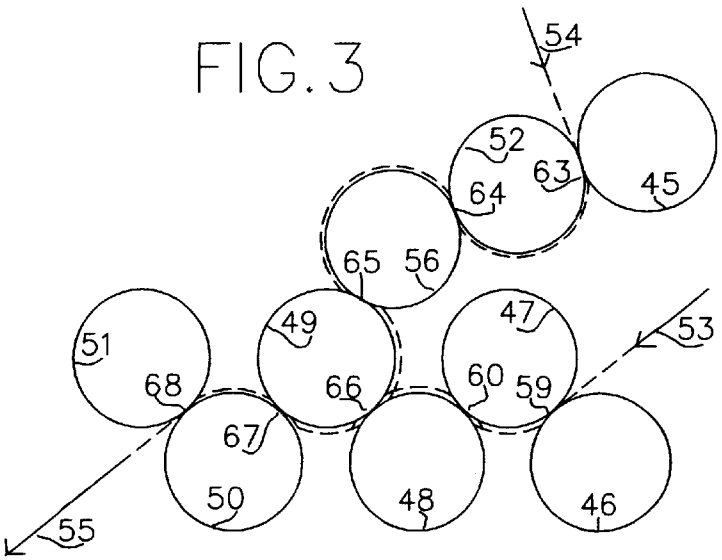
FIG. 3 is a diagrammatic side view of a train of rollers embodying a form of the invention.

FIG. 3 illustrates a diagrammatic side elevation of a train of co-operating rollers embodying a form of the invention and comprising one faster output section incorporating roller 49, 50, 51, a first slower input section incorporating rollers 46, 47, 48 with interleaved teeth and a second slower input section incorporating rollers 45, 52, 56 also with interleaved teeth. Without the said second slower input section 45, 52, 56 the train comprising six rollers, would be basically similar to a six roller train embodying features of the invention. Assuming the input X from arrow 53 is the maximum that can be carded only X could then be delivered at the exit 55 by the faster output section 49, 50, 51. However, the three rollers 45, 52, 56 make up a second slower input section which brings the input Y from arrow 54 and converges on the said first slower input section to meet at a common roller 49 in the body of the train. The speed of roller 49 is much increased. Thus the input Y from 54 joins the input X at roller 49 so that the output at 55=X+Y. By adding three rollers to a six roller train the output at the exit end of the train is doubled.

Figure 4:
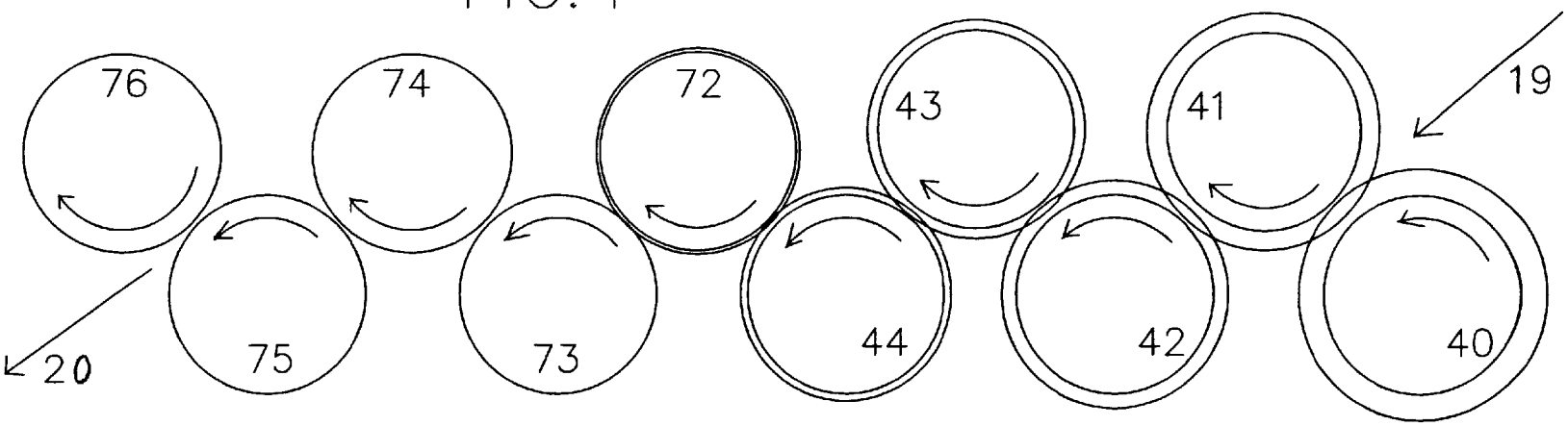
FIG. 4 is a diagrammatic side view of a train of rollers some of which incorporate interleaved teeth and some surface teeth in a form of the invention.
Figure 13:
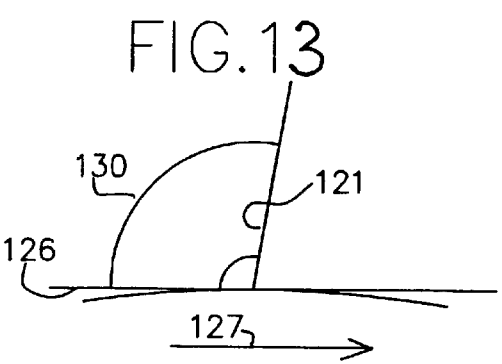
FIG. 13 illustrates a backward facing trailing edge on a tooth.
Figure 12:
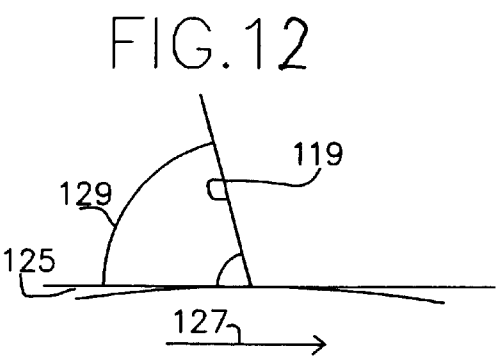
FIG. 12 illustrates an angled rearward trailing edge on a tooth.
Figure 11:
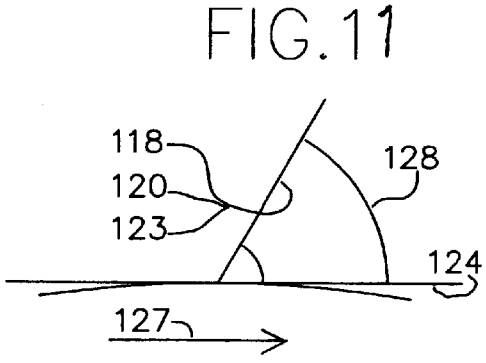
FIG. 11 illustrates an angled forward leading edge on a tooth.

FIG. 4 illustrates a diagrammatic side elevation of a form of the invention including a train of roller, comprising one slower input section comprising roller 40, 41, 42, 43, 44, 72, shown with a double circle and which incorporate interleaved teeth and one faster output section incorporating rollers 73, 74, 75, 76 of which 73, 74, 75 incorporate surface teeth. The height of the interleaved teeth on rollers 40 and 41 is, in this instance, the same but the height of the teeth from roller 41 through rollers 42, 43, 44, to 73 is gradually reduced as the speed of the rollers increase. At roller 72 the height of the teeth is such that the fibres will transfer from roller 72 to surface teeth on roller 73. Thereafter the fibres will be further refined through passage through surface teeth.

It is preferred that the rollers 73 and 74 are made to a basic design similar to that of the rollers incorporating interleaved teeth, but with the height of the teeth and the distance between the rings of teeth being reduced to become surface teeth. If desired, rollers 75 and 76 may be clothed with a modified form of wound-on teeth which will also be surface teeth. They will be described later with reference to FIG. 8. Alternatively, roller 76 may be a doffer or have a doffer immediately associated with it. Other rollers may be added as required. A limitation is speed.

Figure 6:
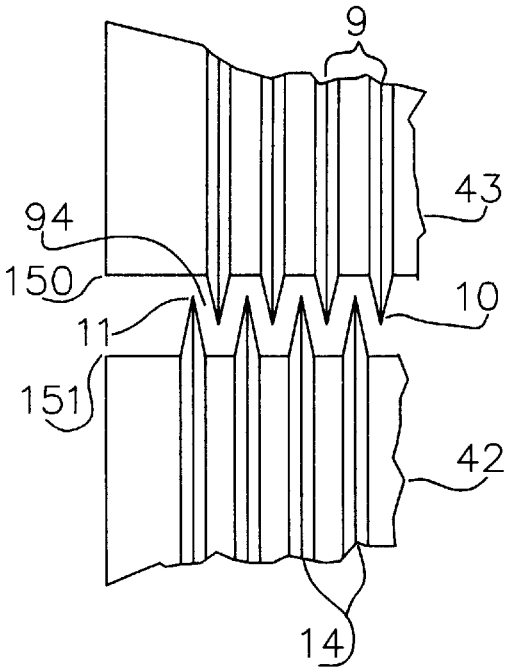
FIG. 6 is a diagrammatic view on a enlarged scale of a side elevation of fragments of rollers 12 and 13 showing rings of interleaved teeth.

Referring to FIG. 6, the distance 94 between interleaved rings of teeth and the height of the teeth must be decided with reference to the thickness of the fibres. If the distance 94 is too great the carding effect will be negligible, if too little, fibre breakage will be caused. By way of indication and not limitation the distance between rings of teeth on a roller to card wool at the entry end of a train covered by this specification could be 12 mm with teeth 6 mm high; at the fastest end of the slower input section the distance between rings of teeth could be 3 mm with teeth 1.5 mm high. When carding cotton fibres the figures may be less; with thicker fibres the figures may be more. The diameter of the rollers may be substantially changed. An arrangement of the feed at the entry end 19 and the take-off at the exit end 20 will be described with reference to separate drawings.

Figure 5:
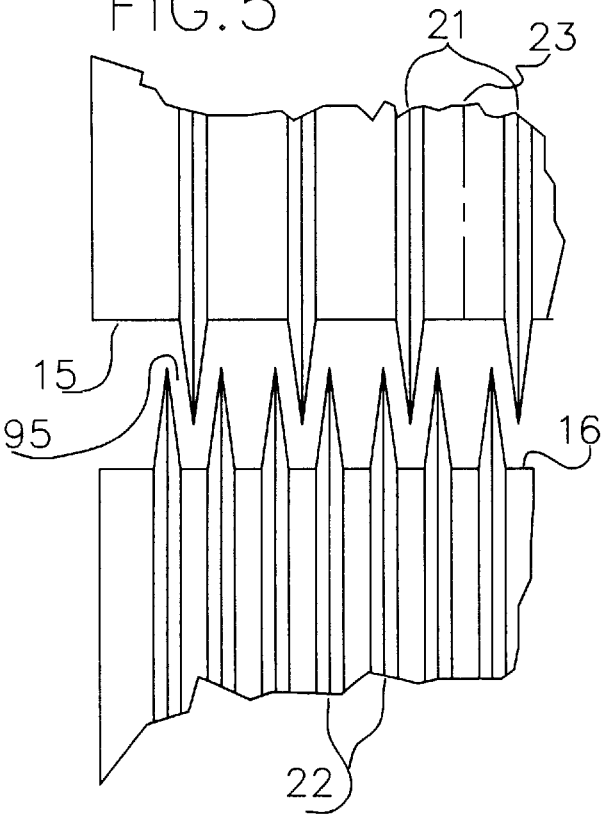
FIG. 5 is a diagrammatic view on an enlarged scale of a side elevation of fragments of co-operating rollers in which the distance between interleaved rings of teeth differs.

Referring now to FIG. 5, a fragmented enlarged view of parts of rollers 15 and 16 illustrates the case in which the distance 95 between interleaved rings of teeth differs. The rings of teeth 21 which are, as normal in this specification, spaced along the roller 15 in the direction of its axis, are twice as far apart as the rings of teeth 22 on roller 16. Rollers 15 and 16 accept fibres in a coarse condition and attenuate and align them as they pass through the zone of co-operation between these rollers. The fibres are then ready for further refining by succeeding rollers. Such rollers would preferably be included in the slower input section of a train.

A further feature of the invention is illustrated in FIG. 5 in which the teeth 22 on roller 16 are slightly offset in relation to the centre-line 23 between the rings of teeth 21 on co-operating roller 15. Such an offset may be varied at succeeding rollers to blend the fibres. The essential clearance between the walls of the teeth is shown at 95.

Referring to FIGS. 4 and 6, typical rollers 42 and 43 illustrate in diagrammatic fragmented view interleaved rings of teeth 9 and 14 in yet another feature of the invention. The height 10 of the teeth 9 on one co-operating roller 43 is uniformly less than the height 11 of the teeth 14 on roller 42. By gradually reducing the height of the teeth on succeeding rollers, preferably combined with lifting surfaces, the fibres are brought closer to the surface of succeeding rollers in the train so that eventually the fibres will readily pass to rollers adapted to carry fibres on surface teeth.

Moreover, it is essential that the rings of teeth 9 on roller 43 are secured in the direction of the axis of the roller 43 in a precisely predetermined position in relation to a datum point 150 on roller 43. It is equally essential that the completed rings of teeth 14 on roller 42 are secured in the direction of the axis of roller 42 in a precisely predetermined position in relation to a datum point 151 on roller 42. It is also important that the datum points on each roller should be maintained in relation to each other during the manufacture of the machine. The same remarks apply to all interleaved rings of teeth on this type of machine. As the rings of teeth 9 and 14 are integral with the special outer part of the rollers 43 and 42 there are no interstices adjacent the bases of the rings of teeth and the special outer part of the rollers 43 and 42.

Figure 7:
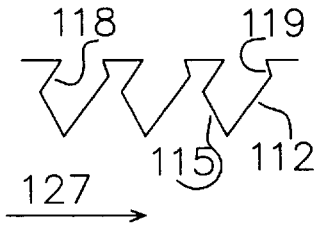
FIGS. 7 and 8 are diagrammatic view of teeth in use in various forms of the invention.
Figure 8:
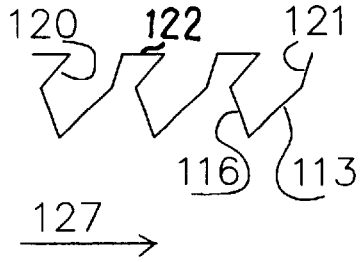

Referring now to FIGS. 4, 7, 8, 9, 12, 13, 14. In FIGS. 7 and 8 teeth are illustrated which have some similar relationships in accordance with the invention. The teeth are shown in profile. The normal direction of rotation of the rollers to which the teeth are attached is shown by the arrow 127 at the lower part of each diagram. The bases 124, 125 and 126 are, in practice, tangents to the circumference.

Figure 10:
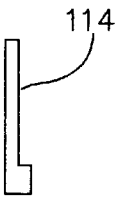
FIG. 10 is a diagrammatic section through teeth in FIGS. 7 and 8.
Figure 9:
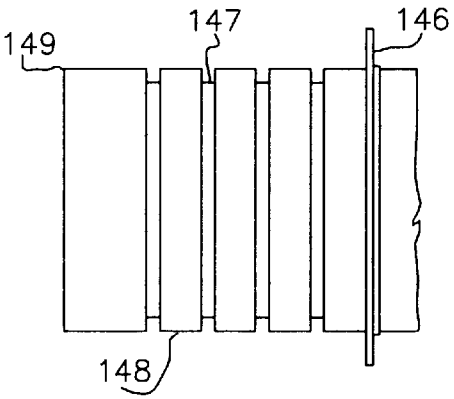
FIG. 9 is a diagrammatic view of a roller with grooves to take interleaved wound-on teeth.

The teeth in FIGS. 7 and 8 are integral with the special outer part of the roller but similar teeth may be integral with or otherwise firmly attached to the base which forms part of the flexible wire base of wound-on teeth as shown in section of 114 in FIG. 10; short lengths of such teeth can be swaged as shown at 146 into parallel grooves 147 cut at predetermined distances from the datum point 149 along a roller 148 in the direction of its axis and be interleaved or, in a much smaller size, be wound-on without grooves in the conventional manner to be used as surface teeth.

The teeth in FIG. 7 have an angled forward leading edge 118 inclined at an angle 128 (FIGS. 7 and 12) in the direction of rotation and, in this case, a much smaller trailing edge 119 inclined at an angle 129 (FIGS. 7 and 13) in the direction opposite to rotation. In this instance, angle 128 would be about 60 degrees and angle 121 about 75 degrees. This combination would form forward-rearward teeth. Also shown are lifting surfaces 112 and 115. These teeth are currently preferred for rollers in the slower input section of a train.

The teeth in FIG. 8 have an angled forward leading edge 120 inclined at an angle 128 in the direction of rotation and a backward facing trailing edge 121 inclined at an angle 130 also in the direction of rotation. These are angled forward-backward facing teeth according to the invention. In this instance the angle 128 would be fifty five degrees and angle 130 would be about one hundred degrees. This arrangement allows the fibres to be attenuated and opened but with a less retarding effect than when the angle 130 is 90 degrees or less. The criterion is that the angle (in this instance 55 degrees) of the leading edge must be substantially less than the complementary angle (80 degrees) to the angle (in this instance 100 degrees) of the angled forward backward facing trailing edge, otherwise no carding can take place. The angles quoted are by way of indication and not limitation.

Lifting surfaces 112, 113, 115 and 116 may be provided; it will be noticed that because part of tooth 121 is angled forward it is itself a lifting surface. The reasons for the lifting surfaces are a) to urge the fibres on the teeth towards the outside edges of the teeth; b) to reduce the tendency of fibres to be drawn between the rings of teeth by faster moving teeth on a co-operating roller and c) to allow more tolerance in adjustment so that teeth in a succeeding roller can engage the fibres.

Figure 15:
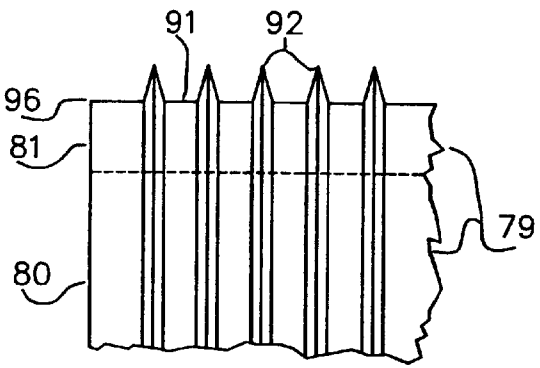
FIGS. 14 and 15 illustrate steps in the method making rollers in accordance with one form of the invention.
Figure 14:
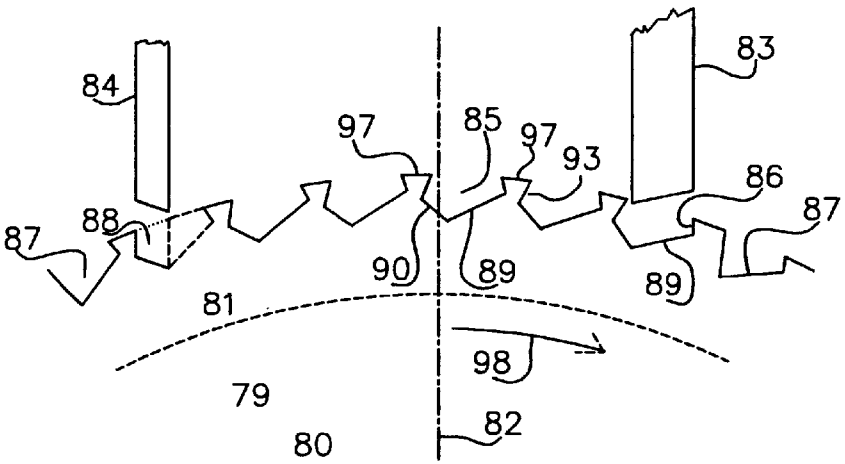

Referring now to FIGS. 6, 7, 8, 14 and 15, the teeth in FIGS. 7, 8 and 14 are typical of those used in the rings of teeth 9 and 14 in FIG. 6 and 92 in FIG. 15. Such teeth in some cases incorporate an angled forward leading edge 118 with an angled rearward lifting surface 115. Similar teeth in some cases incorporate, for example, an angled rearward trailing edge 119 with an angled forward lifting surface 112.

Figure 16:
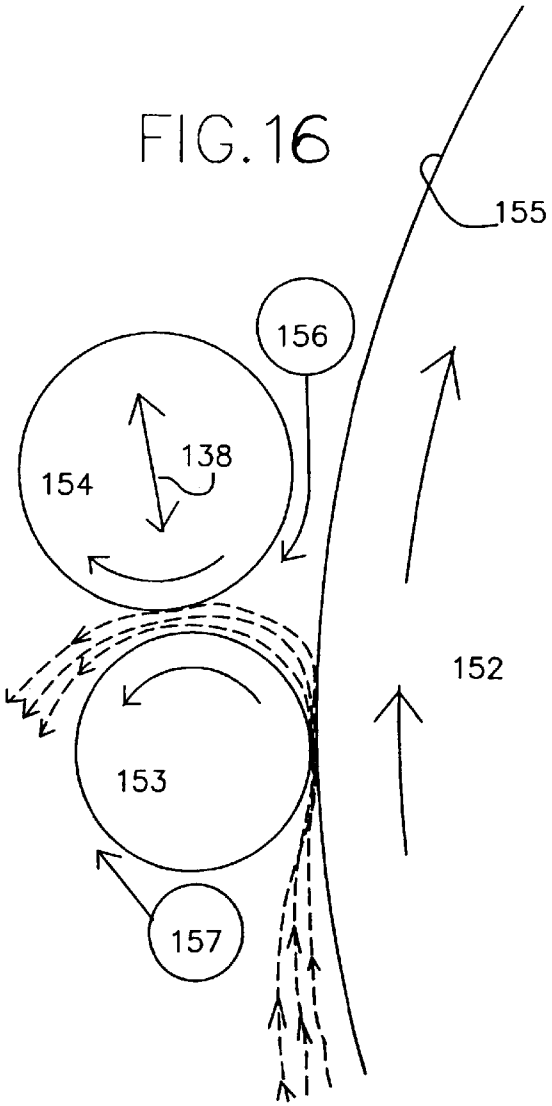
FIG. 16 is a diagrammatic view of the take-off assembly.

Referring to FIGS. 14 and 15, there is now described a method of making a roller suitable for co-operating with other rollers in a carding machine made according to the invention. A steel roller 79 has its special outer part 81 sleeved on to its roller bearing means 80; the dotted lines on FIGS. 15 and 16 give an indication of the joint line.

Using a dividing head, a plurality of axial grooves 87 and 88 are milled lengthwise along the roller in the said special outer part with cutters 83 and 84 which are offset in relation to the centreline 82 of the said roller 79. The shaped cutter 83, correctly offset to the right of the centreline, will produce a backward facing surface 86 (if the roller is rotating in the direction shown by the arrow 98) with a lifting surface 89. With the same direction of rotation the shaped cutter 84, correctly offset to the left of the centerline will produce an angled forward surface 93 with a lifting surface 90.

When the axial grooves 87 and 88 are amalgamated, (as shown by the dotted line adjacent to groove 88) by continued revolution of the dividing head, the grooves will be shaped as shown at 85.

Further, there is machined, along the length of the roller, a plurality of circumferential grooves 91, said grooves being in precise predetermined positions relative to a datum point 96, for instance, the end of the special outer part 81 of the roller 79. The said circumferential grooves 91 cut across the said amalgamated axial grooves 85 thus making a multiplicity of rings of teeth 92, secured in the direction of the axis of its roller in a precisely predetermined position each said ring incorporating forward-rearward teeth 97 integral with the said special outer part 81.

If more teeth are required in a roller of the same diameter smaller teeth must be made; larger diameter rollers may be made to incorporate more teeth or larger teeth but fibre length is a factor to be considered. By changing the angles on the cutters 83 and 84 teeth may be made to meet different requirements to be served by the invention.

A cutter similar to cutter 83 but offset slightly to the left of the centre line 82 is used, when necessary, to produce angled forward backward facing teeth integral with the special outer part as distinct from a metallic wire wound-on to a plain roller. Proper arrangements are made to assemble a train of carding machine co-operating rollers made in the above manner. The rings of teeth on the said rollers will interleave without any interference.

Referring now to FIG. 16, the roller 76 in FIG. 4 is now shown as a doffer 152 rotating in the direction of its arrow and with angled rearwardly teeth 155.

A first take-off roller 153 has a plain surface preferably polished, is adjacent to, has its surface direction (where adjacent) in the same direction as and preferably has its surface speed slightly faster than, the doffer 152, A second take-off roller 154 also has a plain surface preferably polished, is adjacent to, has its surface direction (where adjacent) in the same direction as and has a substantially similar surface speed to, the said first take-off roller 153. The single headed arrows show the relative directions of the rollers 152, 153 and 154.

An air tube 156 is pierced to direct a plurality of jets of air between the doffer 152 and the said second take-off rollers 154 and between the rollers 153 and 154. The fibres are urged by the air between rollers 153 and 154. The clearances between the doffer 152 and the roller 154 and the rollers 153 and 154 may be fixed or adjusted by automatic means such as springs, especially if the rollers 153 and 154 are positioned beneath the doffer 152 to take advantage of gravity to clear the fibres. Such an automatic adjustment may be substantially in the directions of the double headed arrow 138.

By way of indication and not limitation the clearance between the doffer 152 and the first take-off roller 153 is less than one millimeter, the clearance between the doffer 152 and the second take-off roller 154 is between four and six millimeters and the clearance between the first take-off roller 153 and the second take-off roller 154 is four millimeters. If required, a second air tube 157 may be pierced to allow a plurality of jets of air to play on the surface of the said first take-off roller 153 to prevent the fibres encircling the roller 153. The air jets are shown by arrowed lines directly connected to the circle representing the air tubes 156 and 157.

Figure 17:
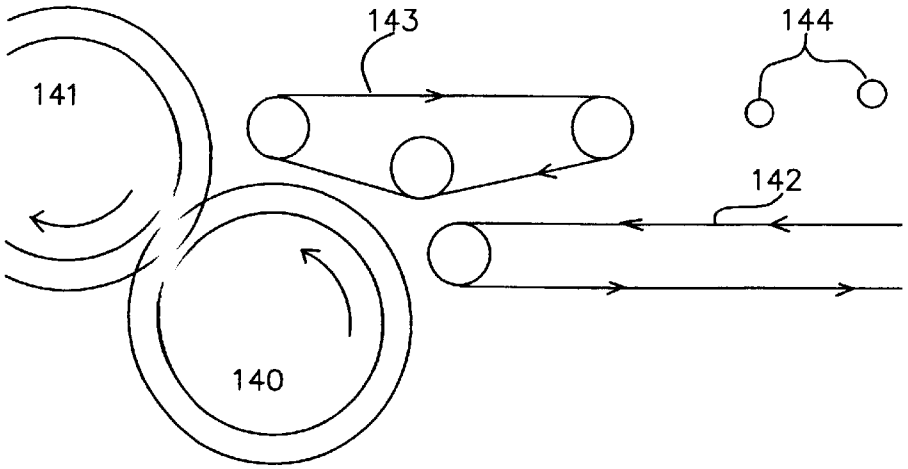
FIG. 17 is a diagrammatic view of a feed compression assembly.

Referring now to FIG. 17. It is permissable in a carding machine made according to this invention that fibres may be compressed into the rollers incorporating interleaved teeth. Rollers 140 and 141 represent rollers 10 and 11 in the train shown in FIG. 4. The feed conveyor 142 brings the fibres in uncarded condition; the small idler rollers 144 which may be made of nylon, stroke the fibres into all approximately level surface. It is desirable that the fibres should not be rolled; to this end a compressor conveyor 143 travels at substantially the same speed as the feed conveyor 142 and the roller 140. As the fibres approach the rollers 140 and 141 they are gently compressed thus increasing the feed of fibres into the slower entry end of the carding machine.

By way of indication but not limitation the diameter of the rollers 30, 31, 32 in FIG. 2, and rollers 40, 41, 42, 43 in FIG. 4 used in the prototype machine which has been used as a guide for this specification is about ten centimeters; the interleaved teeth gradually reduce in height from about 4.5 mm on roller 40. The roller 152 and FIG. 17 is about 200 mm; rollers 153 and 154 are about 50 mm.

The first roller at the entry end of a train of eleven rollers could be 6 r.p.m. and the last roller 750 r.p.m. Different diameter rollers and different speeds between co-operating rollers and different heights of interleaved teeth are factors which may, with advantage, be changed to suit the length and characteristics of the fibres being carded. It is desirable that all the teeth be hardened and tempered.

It is preferred that the speeds of rollers should be independently adjustable so that the passage of the fibres may be adjusted to obtain the maximum output from the machine. It is also preferred that at least the first pair of rollers (for example those shown at 40 and 41 on FIG. 4) should be provided with a safety device in case a foreign body attempts to enter the machine.

INDUSTRIAL APPLICABILITY

The invention seeks to improve the overall efficiency of carding machines.

I claim:

1. A carding machine which includes a train of successive cooperating rollers (15, 16; 30–32; 40–44, 72–76; 148) in which each roller rotates in the opposite direction to, and with a surface speed substantially faster than, its predecessor, said rollers incorporate teeth (28, 29, 37) having a leading edge which, in a radially outer portion (118, 120) thereof, is angled forward in the direction of rotation, said teeth (28, 29, 37) having furthermore a radially inner portion on their leading edge forming a lifting surface (90, 115, 116) which is angled rearward relative to the direction of rotation and said rollers also incorporate teeth (36, 38) having a trailing edge which, in a radially outer portion (119) thereof, is angled rearward relative to the direction of rotation.

2. The carding machine as in claim 1, characterised in that said cooperating rollers (15, 16;30–32;40–44, 72–76) incorporate teeth having a trailing edge, a radially inner portion of which forms an angled forward lifting surface (89, 112, 113).

3. A carding machine which includes a train of successive co-operating rollers (15, 16;30–32;40–44, 72–76) in which each roller rotates in the opposite direction to, and with a surface speed substantially faster than, its predecessor, said rollers incorporate teeth (28, 29, 37) which are angled forward in the direction of rotation and teeth (36, 38) which are angled rearward relative to the direction of rotation, the teeth (28, 29, 36, 37, 38) of at least two successive cooperating rollers being formed on rings (9, 14, 21, 22, 92) of teeth, the rings of teeth on each of these rollers passing in annular spaces between adjacent rings of teeth on the other roller, characterised in that the annular spaces between adjacent rings (9, 14, 21, 22, 92) of teeth (28, 29, 36, 37, 38) of said cooperating rollers (15, 16; 30–32;40–44,72–76;148) are circumferential grooves (91) machined therein in precise predetermined positions relative to a datum point (96;150;151), the rings (9, 14, 21, 22, 92) of teeth (9, 14, 21, 22, 92) are formed from rings remaining integral with their respective roller in precisely predetermined positions relative to its datum point (96;150;151), so that rings of teeth on one cooperating roller may rotate freely without interference between the rings of teeth on any cooperating roller, there being a predetermined clearance (94, 95) maintained between the walls of the said teeth.

4. The carding machine as in claim 3, characterised in that at least some of the teeth (28, 29, 37) on cooperating rollers (15, 16;30–32;40–44,72–76) have a radially inner portion on their leading edge forming a lifting surface (90, 115, 116) which is angled rearward relative to the direction of rotation.

5. A carding machine which includes a train of successive co-operating rollers (15, 16;30–32;40–44,72–76;148) in which each roller rotates in the opposite direction to, and with a surface speed substantially faster than, its predecessor, said rollers incorporate teeth (28, 29, 37) which are angled forward in the direction of rotation, and teeth (36, 38) which are angled rearward relative to the direction of rotation, the teeth (28, 29, 36, 37, 38) of at least two successive cooperating rollers being formed on rings (9, 14, 21, 22, 92) of teeth, the rings of teeth on each of these rollers passing in annular spaces between adjacent rings of teeth on the other roller, characterised in that said cooperating rollers (148) have circumferential grooves (147) machined therein in precise predetermined positions relative to a datum point (149), the rings (9, 14, 21, 22, 92) of teeth are each formed from a length (146) of flexible wire base of wound-on teeth rooted into a respective one of the said circumferential grooves (147), so that rings of teeth on one cooperation roller may rotate freely without interference between the teeth on any co-operating roller, there being a predetermined clearance (94, 95) maintained between the walls of the said teeth.

6. The carding machine as in claim 5, characterised in that at least some of the teeth (28, 29, 37) on cooperating rollers (15,16;30–32;40–44,72–76) have a radially inner portion on their leading edge forming a lifting surface (90, 115, 116) which is angled rearward relative to the direction of rotation.

7. A carding machine as in claim 1, characterised in that the said train is in at least three sections, two slower input sections (46, 47, 48; 45, 52, 56), and one faster output section (49, 50, 51), the said slower input sections (46, 47, 48; 45, 52, 56) bringing fibres from the slower entry ends (53, 54) of the said train, and both said slower input sections (46, 47, 48; 45, 52,53), having a substantially similar degree of carding as they converge on each other to meet at a common roller (49) in the body of the said train, the said common roller (49) collecting fibres from both said slower input sections (46, 47, 48; 45, 52, 56) and delivering those fibres to a faster output section (49, 50, 51), the arrangement being such that the feed of fibres from the slower entry ends (53, 54) of said train is substantially balanced by the faster output of fibres at a common exit end (55) of said train.

8. A carding machine as in claim 1, characterised in that at least two cooperating rollers incorporate a roller bearing means (80), a special outer part (81) and rings of teeth with integral bases (92), the said bases being rooted in the said special outer part (81) of the said rollers (79).

9. A carding machine as in claim 1, characterised in that it includes rollers which have rings of teeth which incorporate forward-rearward teeth (97).

10. A carding machine as in claim 1, characterised in that it includes rollers which have rings of teeth which incorporate angled forward backward facing teeth (121).

11. A carding machine as in claim 1, characterised in that the height of the teeth (10) in one cooperating roller (43) is uniformly less than the height of the teeth (11 in another cooperating roller (42).

12. A carding machine as in claim 1, characterised in that at least some of its teeth incorporate blades (122) circumferentially interconnecting the leading (120) and trailing (121) edges of said teeth.

13. A carding machine as in claim 1, characterized in that the said machine incorporates at least two cooperating rollers with interleaved rings (15, 16) of teeth in which the distance between interleaved rings of teeth (21, 22) differs.

14. A carding machine as in claim 1, characterized in that said machine incorporates cooperating rollers having rings of teeth (22) in which the rings of teeth (22) are offset in relation to the centre line (23) between the rings of teeth on a cooperating roller (15).

15. A method of making carding machine cooperating rollers, comprising the steps of providing, in a special outer part (81) of a roller, a plurality of axial grooves (85) incorporating angled forward (88) and angled rearward (86) surfaces and further providing, in the said special outer part (81), substantially at a right angle to the said axial grooves, a plurality of circumferential grooves (91) machined, in the direction of the axis of its roller, in a precisely predetermined position relative to a datum point (96), whereby there is left, in the said special outer part (81), a multiplicity of rings (92) each incorporating forward-backward teeth (97) integral with the special outer part (81) and a plurality of grooves (91) separating said rings.

16. The method as in claim 15, and further comprising machining said axial grooves (85) to incorporate lifting surfaces (89, 90).

17. A carding machine as in claim 3, characterized in that the said train is in at least three sections, two slower input sections (46, 47, 48; 45, 52, 56), and one faster output section (49, 50, 51), the said slower input sections (46, 47, 48; 45, 52, 56) bringing fibres from the slower entry ends (53, 54) of the said train, and both said slower input sections (46, 47, 48; 45, 52, 53), having a substantially similar degree of carding as they converge on each other to meet at a common roller (49) in the body of the said train, the said common roller (49) collecting fibres from both said slower input sections (46, 47, 48; 45, 52, 56) and delivering those fibres to a faster output section (49, 50, 51), the arrangement being such that the feed of fibres from the slower entry ends (53, 54) of said train is substantially balanced by the faster input of fibres at a common exit end (55) of said train.

18. A carding machine as in claim 3, characterized in that at least two cooperating rollers incorporate a roller bearing means (80), a special outer part (81) and rings of teeth with integral bases (92), the said bases being rooted in the said special outer part (81) of the said rollers (79).

19. A carding machine as in claim 3, characterised in that it includes rollers which have rings of teeth which incorporate forward-rearward teeth (97).

20. A carding machine as in claim 3, characterised in that it includes rollers which have rings of teeth which incorporate angled forward-backward facing teeth.

21. A carding machine as in claim 3, characterised in that the height of the teeth (10) in one cooperating roller (43) is uniformly less than the height of the teeth (11) in another cooperating roller (42).

22. A carding machine as in claim 3, characterised in that at least some of its teeth incorporate blades (122) circumferentially interconnecting the leading (120) and trailing (121) edges of said teeth.

23. A carding machine as in claim 3, characterised in that the said machine incorporates at least two cooperating rollers (15, 16) in which the distance between interleaved rings of teeth (21, 22) differs.

24. A carding machine as in claim 3, characterised in that the rings of teeth (22) are offset in relation to the centre line (23) between the rings of teeth on a cooperating roller (15).

25. A carding machine as in claim 5, characterised in that the said train is in at least three sections, two slower input sections (46, 47, 48; 45, 52, 56), and one faster output section (49, 50, 51), the said slower input sections (46, 47, 48; 45, 52, 56) bringing fibres from the slower entry ends (53, 54) of the said train, and both said slower input sections (46, 47, 48; 45, 52, 53), having a substantially similar degree of carding as they converge on each other to meet at a common roller (40) in the body of the said train, the said common roller (49) collecting fibres from both said slower input sections (46, 47, 48; 45, 52, 56) and delivering those fibres to a faster output section (49, 50, 51), the arrangement being such that the feed of fibres from the slower entry ends (53, 54) of said train is substantially balanced by the faster output of fibres at a common exit end (55) of said train.

26. A carding machine as in claim 5, characterised in that at least two cooperating rollers incorporate a roller bearing means (80), a special outer part (81) and rings of teeth with integral bases (92), the said bases being rooted in the said special outer part (81) of the said rollers (79).

27. A carding machine as in claim 5, characterised in that it includes rollers which have rings of teeth which incorporate forward-rearward teeth (97).

28. A carding machine as in claim 5, characterised in that it includes rollers which have rings of teeth which incorporate angled forward-backward facing teeth (121).

29. A carding machine as in claim 5, characterised in that the height of the teeth (10) in one cooperating roller (43) is uniformly less than the height of the teeth (11) in another cooperating roller (42).

30. A carding machine as in claim 5, characterised in that at least some of its teeth incorporate blades (122) circumferentially interconnecting the leading (120) and trailing (121) edges of said teeth.

31. A carding machine as in claim 5, characterised in that the said machine incorporates at least two cooperating rollers (15, 16) in which the distance between interleaved rings of teeth (21,22) differs.

32. A carding machine as in claim 5, characterised in that the rings of teeth (22) are offset in relation to the centre line (23) between the rings of teeth on a cooperating roller (15).

* * * * *

UNITED STATES PATENT AND TRADEMARK OFFICE

CERTIFICATE OF CORRECTION

PATENT NO. : 6,035,493

DATED : March 14, 2000

INVENTOR(S) : William Charles Carlton

It is certified that error appears in the above-identified patent and that said Letters Patent is hereby corrected as shown below:

In column 11, lines 32-35, please delete.

In column 11, line 42, please insert --with upper and lower portions-- after "edge".

In column 11, line 42, please delete "which".

In column 11, line 42, please delete "in a".

In column 11, line 42, please insert --the upper portion is-- before "radially".

In column 11, line 42, please delete "portion".

In column 11, line 43, please delete "is" and insert in lieu thereof --and--.

In column 11, line 44, please delete "said teeth (28, 29, 37) having furthermore a".

In column 11, line 44, please insert --the lower portion is-- before "radially".

In column 11, line 45, please delete "portion". and insert --thereof--.

UNITED STATES PATENT AND TRADEMARK OFFICE

CERTIFICATE OF CORRECTION

PATENT NO. : 6,035,493

DATED : March 14, 2000

INVENTOR(S) : William Charles Carlton

It is certified that error appears in the above-identified patent and that said Letters Patent is hereby corrected as shown below:

In column 2,line 4, please change "for", second occurrence, to --form--.

In column 3, line 22, please change "to" to --of--.

In column 5, line 15, please change "view" to --views--.

In column 5, line 34, please change "NODES" to --MODES--.

In column 5, line 61, please change "achieve" to --achieved--.

In column 6, line 2, please change "indicated" to --indicates--.

In column 6, line 37, please delete "is".

In column 7, line 5, please change "an" to --on--.

In column 7, line 13, please change "aster" to --faster--.

In column 7, line 25, please change "roller" to --rollers--.

In column 7, lines 44 and 45, please change "roller" to --rollers--.

In column 9, line 1, please change "of", first occurrence, to --at--.

In column 9, line 12, please change "121" to --129--.

In column 10, line 43, please change "rollers" to --roller--.

In column 11, line 3, please change "all" to --an--.

In column 11, line 15, please change "and" to --on--.

UNITED STATES PATENT AND TRADEMARK OFFICE

CERTIFICATE OF CORRECTION

PATENT NO. : 6,035,493
DATED : March 14, 2000
INVENTOR(S) : William Charles Carlton It is certified that error appears in the above-identified patent and that said Letters Patent is hereby corrected as shown below:

In column 11, line 45, please delete "their", and insert in lieu thereof --the--.

In column 11, line 45, please insert --and-- after "edge".

In column 11, line 46, please delete "which is".

In column 11, line 46, please change "rearward" to --rearwardly--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*